United States Patent [19]

Tremaine et al.

[11] Patent Number: 4,890,977

[45] Date of Patent: Jan. 2, 1990

[54] VARIABLE INLET GUIDE VANE MECHANISM

[75] Inventors: Eric Tremaine; Allan B. Newland, both of Quebec, Canada

[73] Assignee: Pratt & Whitney Canada, Inc., Quebec, Canada

[21] Appl. No.: 289,114

[22] Filed: Dec. 23, 1988

[51] Int. Cl.[4] ..... F01D 17/00

[52] U.S. Cl. ..... 415/164; 415/150

[58] Field of Search ..... 415/150, 151, 159, 160, 415/161, 162, 163, 164; 403/349, 348

[56] References Cited

U.S. PATENT DOCUMENTS

| | | | |
|---|---|---|---|
| 2,083,186 | 6/1937 | Anderson | 415/160 |
| 3,033,519 | 5/1962 | Radtke | 415/164 |
| 3,574,479 | 4/1971 | Barnard | 415/160 |
| 3,972,644 | 8/1976 | Johnson | 415/163 |
| 4,439,104 | 3/1984 | Edmonds | 415/161 |
| 4,618,311 | 10/1986 | Miura et al. | 415/149 R |
| 4,695,220 | 9/1987 | Dawson | 415/9 |
| 4,720,237 | 1/1988 | Weiner et al. | 415/150 |

FOREIGN PATENT DOCUMENTS

| | | | |
|---|---|---|---|
| 3541508 | 2/1987 | Fed. Rep. of Germany | 415/164 |
| 546670 | 7/1956 | Italy | 415/164 |
| 138592 | 2/1921 | United Kingdom | 415/164 |
| 1225739 | 3/1971 | United Kingdom | 415/163 |
| 2168769 | 6/1986 | United Kingdom | 403/349 |

*Primary Examiner*—Randall L. Green
*Assistant Examiner*—John T. Kwon
*Attorney, Agent, or Firm*—Troxell K. Snyder

[57] ABSTRACT

A ring gear (20) rotates circumferentially about a plain bearing (22) secured to the housing (10) of a centrifugal gas compressor. The ring gear (20) drives sector gears (18) for positioning variable guide vanes (14). A lever arm (32), actuator (36) and linkage (38, 40, 50) is provided for driving the ring gear (20).

7 Claims, 2 Drawing Sheets

VARIABLE INLET GUIDE VANE MECHANISM

FIELD OF THE INVENTION

The present invention relates to an actuator system for positioning a plurality of guide vanes in a turbomachine.

BACKGROUND

The use of one or more stages of pivoting guide vanes in a turbomachine having an annular gas flow, or the like, is well known in the gas turbine engine and compressor art. Such guide vane stages comprise a plurality of individual vanes distributed circumferentially about the annular gas stream and pivoting in unison under the influence of a mechanical linkage.

One particular arrangement utilizes a plurality of small vane gears each secured to a central vane spindle oriented spanwisely with respect to a corresponding individual vane, with each vane gear meshing with an annular ring gear for establishing synchronized collective motion of the vane stage. An example of this general type of arrangement may be seen in the disclosure of U.S. Pat. No. 4,439,104 issued to Edmonds. The ring gear of the Edmonds disclosure is supported by an external housing of the compressor portion of the turbomachine, with individual gears secured to a spindle section of each vane for collectively and simultaneously positioning each of the Edmonds' inlet guide vanes.

The positioning of the ring gear, and hence the collective positioning of the entire vane stage, is accomplished in the prior art by coupling one of the vane gears to a rotary actuator, with that particular gear then functioning as a drive pinion for driving the ring gear and thus the remaining vane gears. While effective, such a system includes a number of inherent disadvantages, foremost of which is the premature wearing of the driving pinion gear which transmits the entire actuator force to the ring gear. Such premature wear can result in increased mechanical backlash between the pinion gear and the remaining driven gears, and in the extreme case such backlash may in fact diminish overall turbomachine performance by leaving a mismatch between the desired and actual orientation of the vane stage.

Another disadvantage of the prior art pinion gear system is the localized premature wear on the ring gear support bearing which must accommodate a locally high radial force in the vicinity of the pinion gear. Such localized wearing not only shortens the service life of the ring gear support bearing, but can exacerbate the localized gear tooth wear and backlash problem.

What is required is a vane actuation system which avoids undesirable localized wear of one or more of the vane gears and the synchronizing ring gear.

SUMMARY OF THE INVENTION

It is therefore an object of the present invention to provide a system for simultaneously positioning a plurality of gas flow directing vanes disposed in an annular gas flow, such as may be found in an axial flow turbomachine, or the like.

It is further an object of the present invention to provide a system which does not experience uneven wear in the vane actuation linkage due to overutilization of one or more of the vane positioning components.

It is further an object of the present invention to position the gas flow directing vanes by means of a rotating ring gear driven by a lever shaped to avoid lateral moment forces on the gear ring.

It is still further an object of the present invention to provide a ring gear support means which is released only when the ring gear is moved to a release position outside of the normal operating range of rotation thereof.

According to the present invention, an actuation system for simultaneously pivoting a plurality of gas flow directing vanes is provided for an axial turbomachine, or the like. The system includes a single ring gear disposed about the housing of the turbomachine and supported by a radial bearing. The ring gear includes a toothed track which engages a plurality of correspondingly toothed gears secured to each vane. Circumferential movement of the ring gear in an operating range of motion causes the vanes to collectively and simultaneously pivot in the gas flow.

The ring is retained axially by a releasable bayonnet lock wherein a plurality of radially extending lugs or dogs present axial movement of the ring gear as it rotates within the normal operating range. The ring gear includes a plurality of axial slots which become aligned with the radial housing lugs only when the ring gear is rotated into a release position beyond the normal operating angle of motion. In this position, the ring gear can be slipped axially from the radial bearing for removal or replacement.

Circumferential movement of the ring gear is accomplished via a lever secured over a portion of the ring gear and driven by a linkage connected to an actuator mounted on the turbomachine housing. The lever is shaped to place the drive bearing directly in line with the ring gear track and vane gears, thereby avoiding lateral or other imbalance forces on the ring gear. The linkage is adapted to provide selective movement to a drive bearing disposed in the lever arm and spaced apart from the ring gear. Such linkage may include an intermediate torque shaft having input and output crank arms for achieving a mechanical advantage in the driving force and/or permitting the linear actuator and drive ring to be mounted in axially spaced apart locations on the turbomachine housing.

Both these and other objects and advantages of the actuation system according to the present invention will be apparent to those skilled in the art upon review of the following specification, and the appended claims and drawing figures.

DETAILED DESCRIPTION OF THE DRAWINGS

DETAILED DESCRIPTION OF THE PREFERRED EMBODIMENT

Figure 1:
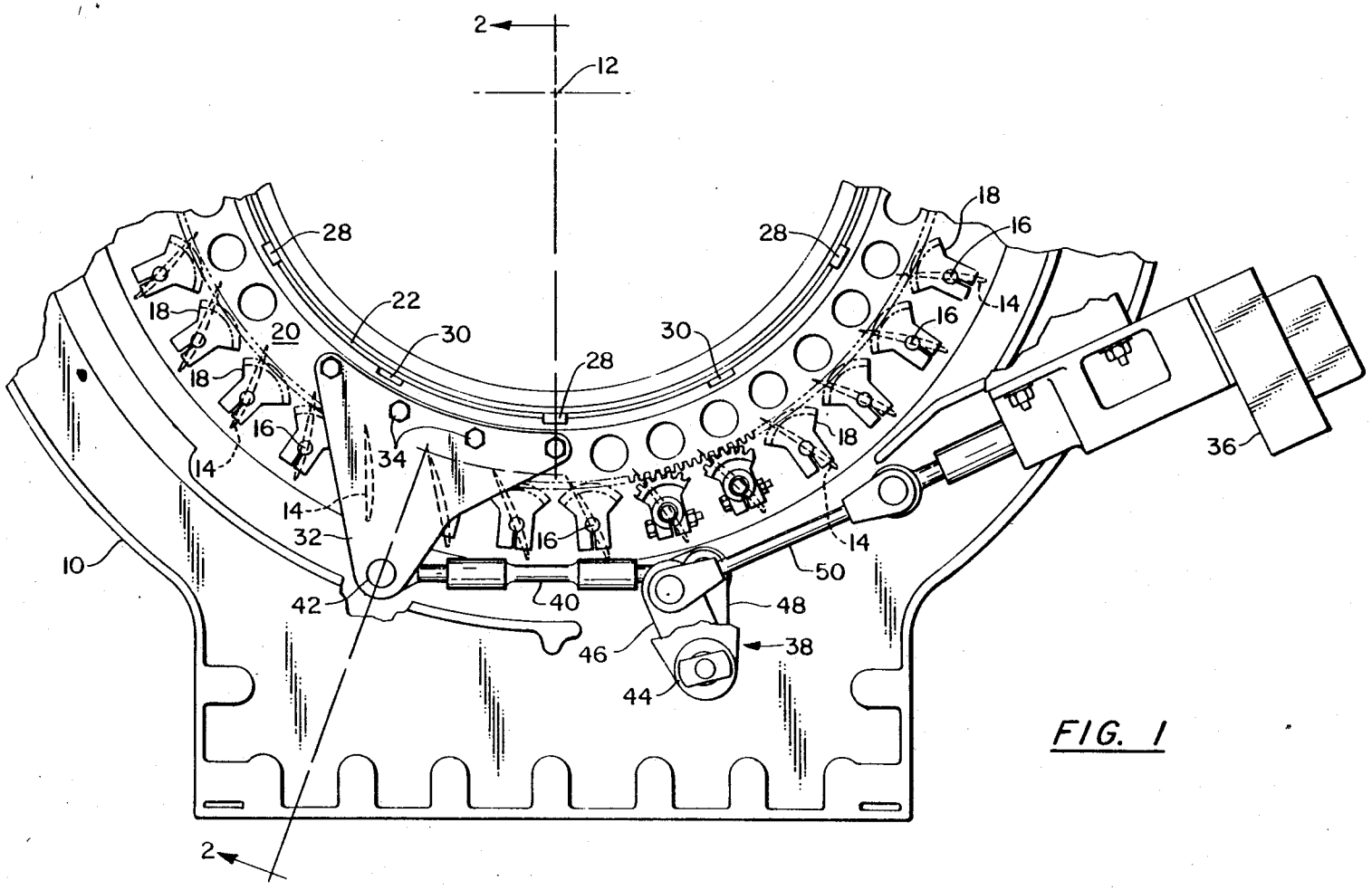
FIG. 1 shows a cross section of a radial inflow compressor intake taken perpendicular to the central compressor axis.

FIG. 1 shows a cross section of a radial to axial annular intake for a centrifugal gas compressor. The intake comprises a housing 10 disposed about a central axis 12. A plurality of pivotable inlet guide vanes 14 are disposed circumferentially about the housing 10, each vane including a spindle 16 lying parallel to the engine central axis 12 and passing through the housing 10.

Secured to each spindle 16 is a sector shaped vane gear 18 which is engaged with an annular ring gear 20 for positioning the inlet guide vanes 14 collectively and simultaneously. The ring gear 20 rides on a plain annular bearing 22 which is supported by the housing 10 at the radially inner diameter of the ring gear 20.

Figure 2:
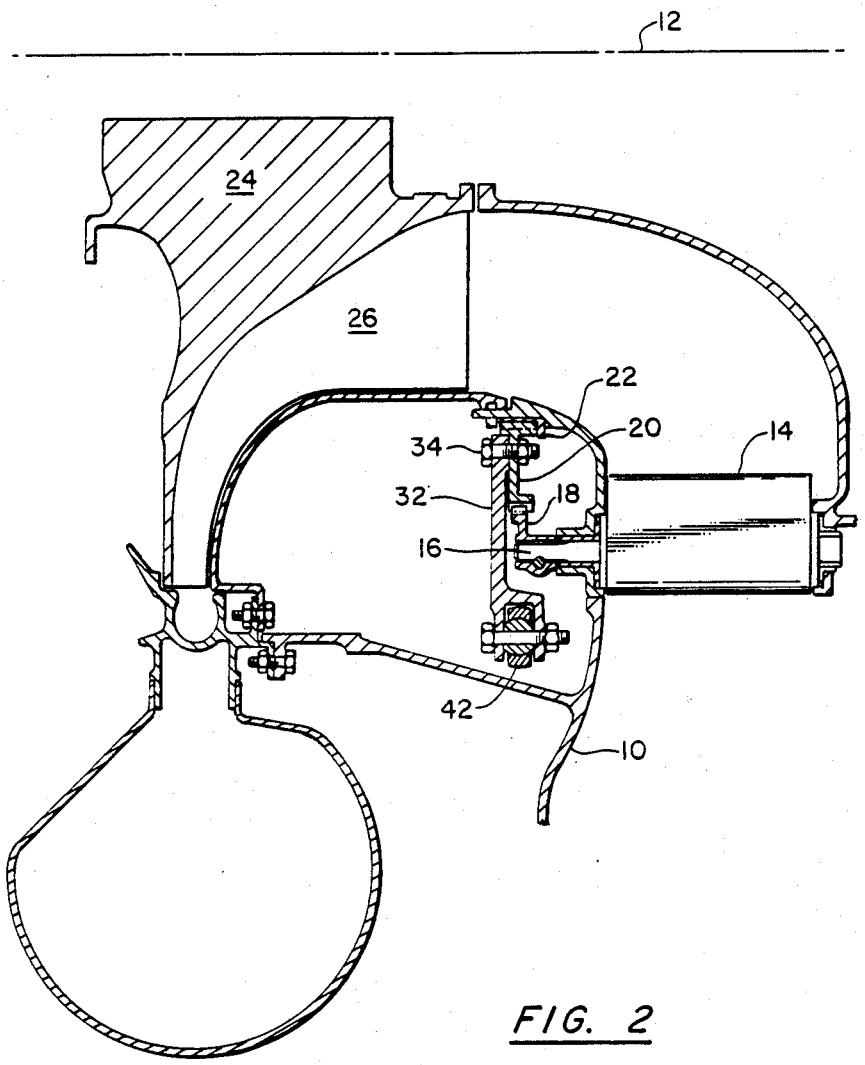
FIG. 2 shows the indicated cross section of FIG. 1, taken in the plane of the central axis and showing details of the ring gear and lever arm according to the present invention.

FIG. 2 shows the indicated cross section of FIG. 1 giving an additional view of the housing 10, inlet guide vane 14 and spindle 16. As can be seen more clearly in FIG. 2, the inlet guide vane 14 is supported by the housing 10 at each span end of the vane airfoil 14, with the spindle end 16 extending through the housing 10 and being secured to the sector shaped gear 18. The plain bearing 22 is also visible radially inward of the ring gear 20. Also shown in FIG. 2 is the compressor rotor 24 and impeller blades 26.

Ring gear 20 is retained axially by a plurality of radially extending dogs 28 most clearly seen in FIG. 1. These dogs 28 extend radially outward from the diameter of the plain bearing 22, creating an axial interference with the ring gear 20 as it rotates circumferentially through an operating range of motion. The ring gear 20 is released from the housing 10 and dogs 28 by rotating the ring gear 20 outside of the normal operating range of motion such that a corresponding plurality of axially extending slots 30 disposed in the ring gear inner diameter of the ring gear 20 become aligned with the dogs 28. In this orientation the ring gear 20 may be slipped axially from the plain bearing and released from the housing 10.

Ring gear 20 is translated circumferentially by the actuation system according to the present invention via a lever arm 32 which is secured over a sector portion of the ring gear 20 by various means of attachment such as bolts 34. Lever arm 32 is in turn driven by a linear actuator 36 via an intervening linkage 38. Linkage 38 includes a drive link 40 which is coupled to the lever arm 32 at a drive bearing 42.

Lever arm 32 is unique in transferring the driving force supplied to bearing 42 by the drive link 40 without imparting undesirable lateral force or twisting moment to the ring gear 20. This is accomplished by shaping lever arm 32 as shown in FIG. 2 such that the ring gear 20, sector gear 18, and drive bearing 42 lie in the same radial plane with respect to the central axis 12. Thus, driving force transferred from the drive bearing 42 by the lever arm 32 to the ring gear 20 remains aligned with the ring gear 20 and sector gear 18 thereby avoiding unnecessary wear or force at the plain bearing 22.

The drive linkage 38 as disclosed herein also includes an intermediate torque tube 44 extending parallel to the central axis 12 and including first and second crank arms 46, 48. First crank arm 46 is positioned according to the movement of the linear actuator 36 by the connecting link 50 extending therebetween. The second crank arm 48 is secured pivotally to the drive link 40 thereby transferring the driving motion from the actuator 36 to the drive bearing 42. Torque tube 44 is supported by journal bearings or the like (not shown) in housing 10 and provides a dual function by permitting not only the use of different length first and second crank arms 46, 48 to achieve a mechanical advantage between the movement of the linear actuator 36 and the movement of the lever arm 32, but also allowing the linear actuator 36 and lever arm 32 to be axially spaced apart should the particular configuration of the turbomachine require.

It should now be apparent that the actuation system according to the present invention is particularly well adapted for positioning the plurality of inlet guide vanes 14 by means of a ring gear and a plurality of sector gears 18 as disclosed herein. The lever arm 32 transfers the movement of the linear actuator 36 mounted on the housing 10 to the ring gear 20 without overutilizing any particular sector gear 18 or portion of the ring gear 20. The dog and slot 28, 30 arrangement of axially retaining the ring gear 20 to the housing 10 provides a simple and essentially foolproof method of releasably securing the ring gear 20 during operation of the turbomachine.

By displacing axially the radially outer portion of the lever arm 32 which includes the drive bearing 42, the actuation system according to the present invention results in the drive bearing 42, sector gears 18, and ring gear 20 being all coplanar, thereby avoiding any lateral thrust or bending moment in the unison gear or supporting bearing 22 as the ring gear 20 is circumferentially displaced throughout the operating range of motion. By avoiding such undesirable moment or lateral forces, the actuation system according to the present invention reduces premature wear and stress of the individual system components thereby lengthening service life and reducing maintenance time and cost.

Finally, the linkage 38 comprising the drive link 40, connecting link 50, first and second crank arms 46, 48 and torque tube 44 provide a degree of flexibility unknown in the art with regard to the positioning and transfer of the positioning force supplied by the linear actuator 36 to the drive bearing 42.

Although disclosed and described with regard to the particular turbomachine inlet shown in the drawing figures, it will be appreciated that the system according to the present invention is equally applicable to a variety of similar turbomachines, and therefore the preceding disclosure is intended to only illustrate one particular and preferred embodiment of the present invention rather than to impute any limitations beyond those specifically recited in the following claims.

We claim:

1. An actuator system for simultaneously pivoting a plurality of guide vanes in a turbomachine having an annular gas flow path, the guide vanes spaced circumferentially about the gas flow path and pivotally secured to a nonrotating annular housing of said turbomachine, each of the plurality of vanes including a spindle portion, coincident with the pivot axis thereof and extending through the housing, wherein the system comprises:

a ring gear, disposed about the annular housing and supported radially with respect thereto, the ring gear further including a circumferentially extending toothed track, a plurality of vane gears, each gear secured to a vane spindle and including an arcuate toothed portion engaged with the toothed track, means, disposed between the housing and the ring gear, for selectively rotating the ring gear circumferentially within an operating range of motion, means, disposed between the housing and the ring gear, for axially restraining the ring gear during movement within the operating range of motion, said retaining means further being releasable when the ring gear is circumferentially rotated into a release position lying outside of the operating range of motion.

2. The actuator system as recited in claim 1 wherein the ring gear includes a plurality of axially extending slotted openings disposed therein, and wherein the restraining means includes a plurality of lugs extending radially from the housing past a portion of the ring gear, the lugs further being aligned with the axially slotted openings only when the ring gear is rotated to the release position, thereby allowing the ring gear to be released axially for removal from the housing.

3. The actuator system as recited in claim 1 wherein the means for selectively rotating the ring gear includes a lever arm secured to a sector of the ring gear and extending generally locally perpendicular with respect thereto, the lever arm including a drive bearing spaced apart from the ring gear, said drive bearing lying in a plane defined, at least locally, by the toothed ring gear track and the toothed sector gears, and means for selectively driving the lever arm via the drive bearing.

4. The actuator system as recited in claim 3 wherein the driving means includes a linear actuator, secured to the housing, and means for mechanically linking the linear actuator and the drive bearing.

5. The actuator system as recited in claim 4 wherein the linking means includes a torque shaft journalled to the housing and rotatable about an axis parallel to the rotation axis of the ring gear, the torque shaft further including first and second crank arms extending perpendicular to the shaft rotation axis, the first crank arm connected to the linear actuator by a connecting link, and the second crank arm connected to the drive bearing by a drive link.

6. The actuator system as recited in claim 5 wherein the first and second crank arms are spaced axially with respect to the torque shaft rotation axis.

7. The actuator system as recited in claim 1 wherein the toothed track on the ring gear is disposed at the radially outer periphery thereof, the pivot axes of the plurality of guide vanes are each parallel to the central axis of the turbomachine, and wherein the lever arm extends radially outward from the ring gear with respect to the central turbomachine axis.

* * * * *